US011407002B2

(12) United States Patent
Smith

(10) Patent No.: US 11,407,002 B2
(45) Date of Patent: Aug. 9, 2022

(54) HAND TOOL FOR APPLICATION OF A VISCOUS MATERIAL WITH MOVABLE GUIDE

(71) Applicant: Carl Smith, Toronto (CA)

(72) Inventor: Carl Smith, Toronto (CA)

( * ) Notice: Subject to any disclaimer, the term of this patent is extended or adjusted under 35 U.S.C. 154(b) by 0 days.

(21) Appl. No.: 17/196,560

(22) Filed: Mar. 9, 2021

(65) Prior Publication Data

US 2021/0276039 A1 Sep. 9, 2021

Related U.S. Application Data

(60) Provisional application No. 62/986,917, filed on Mar. 9, 2020.

(51) Int. Cl.
*B05C 17/01* (2006.01)
*B05C 17/005* (2006.01)

(52) U.S. Cl.
CPC .... *B05C 17/0123* (2013.01); *B05C 17/00589* (2013.01)

(58) Field of Classification Search
CPC ..... B05C 17/0123; B05C 17/00589
USPC ..... 222/538
See application file for complete search history.

(56) References Cited

U.S. PATENT DOCUMENTS 12,182 A * 1/1855 Hicks ..... B43K 23/004 401/48
2,549,722 A * 4/1951 Sweet ..... E01C 23/246 401/48
3,381,861 A * 5/1968 Stein ..... B05C 17/0136 222/256
3,987,939 A * 10/1976 Pedone, Jr. ..... B05C 17/01 222/325
4,260,273 A * 4/1981 Hemperly, Jr. ..... B29C 66/861 401/48
4,509,662 A * 4/1985 Weiss ..... B05C 17/0123 222/327
4,932,565 A * 6/1990 Paradiso ..... B05C 17/00589 222/174
5,228,605 A * 7/1993 Schlichenmaier ..... B05C 17/00589 222/327

(Continued)

FOREIGN PATENT DOCUMENTS

CN 105689211 A 6/2016
WO 90/06815 A1 6/1990

(Continued)

*Primary Examiner* — Paul R Durand
*Assistant Examiner* — Michael J. Melaragno
(74) *Attorney, Agent, or Firm* — Bereskin & Parr LLP/S.E.N.C.R.L., s.r.l.; Tony Orsi

(57) ABSTRACT

A tool for applying a viscous material to a surface. The tool comprises: a body having a frame including at least a partial wall defining a cavity having a size for removably receiving a dispensing container that contains the viscous material; a dispensing assembly that is operatively coupled to the body and has a forcing member for applying force to the dispensing container to dispense the viscous material; (3) a control element attached to the body for controlling the application of the applied force by the movable member of the dispensing assembly; and (4) a guide movably attached to the body, the guide being movable between an operating position and a storage position.

15 Claims, 6 Drawing Sheets

(56) References Cited

U.S. PATENT DOCUMENTS 5,413,258 A * 5/1995 Kartler ..... E04F 21/1652 222/575
5,656,126 A * 8/1997 Martinez ..... B29C 65/12 156/304.1
5,875,920 A * 3/1999 Parent ..... B05C 17/01 222/1
6,041,976 A * 3/2000 Robertson ..... B05C 17/00589 222/333
6,220,485 B1 * 4/2001 Chang ..... B05C 17/01 222/174
D455,619 S * 4/2002 Chang ..... D8/14.1
6,866,716 B1 * 3/2005 Montemurro ..... B44D 3/16 118/211
6,926,177 B1 * 8/2005 Scott ..... B05C 17/00516 222/390
8,561,848 B2 * 10/2013 Gardner ..... B05C 17/01 222/174
8,733,276 B2 5/2014 Martin
9,212,297 B2 * 12/2015 Gausepohl ..... B05C 17/00589
2006/0163293 A1 7/2006 Peay
2006/0254057 A1 * 11/2006 Houseman ..... B26F 1/32 30/92
2008/0083790 A1 * 4/2008 Tseng ..... B05C 17/0123 222/391
2011/0240686 A1 * 10/2011 McClurg ..... B05C 17/0052 222/545
2015/0053717 A1 * 2/2015 Williams ..... B05C 17/0126 222/95

FOREIGN PATENT DOCUMENTS

WO 93/16810 A1 9/1993
WO 95/04605 A1 2/1995

* cited by examiner

HAND TOOL FOR APPLICATION OF A VISCOUS MATERIAL WITH MOVABLE GUIDE

CROSS-REFERENCE TO RELATED APPLICATION

This application claims the benefit of U.S. Provisional Patent Application No. 62/986,917 filed Mar. 9, 2021 and the entire contents of U.S. Provisional Patent Application No. 62/986,917 are hereby incorporated herein in its entirety.

FIELD

Various embodiments are described herein that generally relate to the field of handheld tools. In particular, the embodiments described herein generally relate to the field of handheld tools that facilitate the application of viscous materials, such as free flowing pastes, adhesives, fillers and sealants, to surfaces.

BACKGROUND

Materials such as caulk, sealants, fillers and other free flowing pasty materials, collectively referred to herein as viscous materials, are widely used in residential and commercial construction and finishing projects. Viscous materials are often packaged and distributed in sealed dispensing tubes. These tubes often have a plunger mechanism at one end, and a sealed nozzle at the other end. To dispense the contents of the tube, an operator removes or slices the tip of the sealed nozzle, and applies pressure on the plunger at the other end. The plunger is in communication with the viscous material within the tube. Accordingly, applied pressure on the plunger transfers to the viscous material, which increases the pressure on the viscous material within the tube and urges the viscous material to flow out of the dispensing tube via the opening in the tip.

A considerable amount of force may be required to generate sufficient pressure to force the viscous material out of the dispensing tube. It is therefore commonplace for users, i.e. operators, to use hand tools or apparatuses to assist in generating the necessary applied force. These apparatuses are widely available. These apparatuses are referred to herein as hand tools. Commonly, hand tools are designed to receive the sealed dispensing tubes. They also have a mechanism that allows the operator to apply a force onto the plunger of the dispensing tube, often with a mechanical advantage so that the operator does not have to apply as much force to dispense the viscous material. The operator can apply the necessary force using one hand while holding the hand tool with the other hand. The shape and size of the hand tool may allow the operator to move their arms to dispense the viscous material at/along a desired point of application. The desired point of application may be anyone of, but not limited to toilets, sinks, baseboards, window sills, door sills, window casings, door casings, window jambs, door jambs, construction surfaces, and between certain construction materials such as floor tiles.

Some applications of viscous materials, such as the application of caulking, sealants and/or adhesives, require considerable precision. Since some viscous materials, such as caulking, sealants and adhesives may be visible after a project is completed, one may consider the aesthetic appearance of the applied viscous material and therefore may desire additional precision. In some cases, hand tools with dispensing tubes installed may be heavy and difficult to maneuver, which may inhibit one's ability to apply the viscous material in a precise manner. Moreover, operators of hand tools may be at risk of injury, fatigue, and/or imprecise operation of the hand tool when operating the hand tool with an installed dispensing tube for long periods of time.

SUMMARY OF VARIOUS EMBODIMENTS

This summary is intended to introduce the reader to various aspects of the applicant's teaching, but not to define any specific embodiments.

In accordance with one broad aspect of the teachings herein, there is provided a tool for applying a viscous material to a surface, comprising: a body having a frame including at least a partial wall defining a cavity having a size for removably receiving a dispensing container that contains the viscous material; a dispensing assembly that is operatively coupled to the body and has a forcing member for applying force to the dispensing container to dispense the viscous material; a control element attached to the body for controlling the application of the applied force by the movable member of the dispensing assembly; and a guide movably attached to the body, the guide being movable between an operating position and a storage position.

In at least one embodiment, a first proximal portion of the guide is rotatably coupled to a first portion of the body of the tool about a first pivot point to allow the guide to be rotated between the storage and operating positions.

In at least one embodiment, the guide comprises two members each having proximal ends that are spaced apart from one another and coupled near the first portion of the body and distal ends that are coupled to one another.

In at least one embodiment, a distal portion of the guide comprises a guide wheel to make contact with the surface when an operator is dispensing the viscous material during operation.

In at least one embodiment, the tool further comprises a biasing member coupled between a second portion of the body and a second proximal portion of the guide for biasing the guide towards the operating position.

In at least one embodiment, the tool further comprises a retaining member that is coupled to a third portion of the body and has a flange or a channel for receiving and maintaining a part of the distal portion of the guide in the storage position.

In at least one embodiment, the forcing member comprises a plunger for applying the force to a movable end of the dispensing container.

In at least one embodiment, the control element comprises a hand operated lever.

In at least one embodiment, the tool further comprises a handle and the control element is rotatably coupled to the handle.

In at least one embodiment, the handle is integrated into the body.

In another broad aspect, in accordance with the teachings herein, there is provided a method of operating a tool defined according to any of the embodiments described herein where the tool includes the dispensing container, wherein the method comprises: retrieving the tool; moving the guide from the storage position to the operating position; operating the tool with the assistance of the guide; moving the guide from the operating position to the storage position, and; storing the tool.

In at least one embodiment, the method further comprises operating the tool without the assistance of the guide after moving the guide from the operating position to the storage position.

In at least one embodiment, the guide is a guide wheel, and wherein operating the tool with the assistance of the guide comprises contacting the surface with the guide wheel while dispensing the viscous material.

In at least one embodiment, a first proximal portion of the guide is rotatably coupled to a first portion of the body of the tool about a first pivot point and wherein moving the guide from the storage position to the operating position comprises rotating the guide between the storage and operating position.

In at least one embodiment, the tool further comprises a retaining member that is coupled to a third portion of the body and has a flange or a channel for receiving and maintaining a part of the distal portion of the guide in the storage position and wherein moving the guide from the operating position to the storage position comprises engaging the guide with the retaining member.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
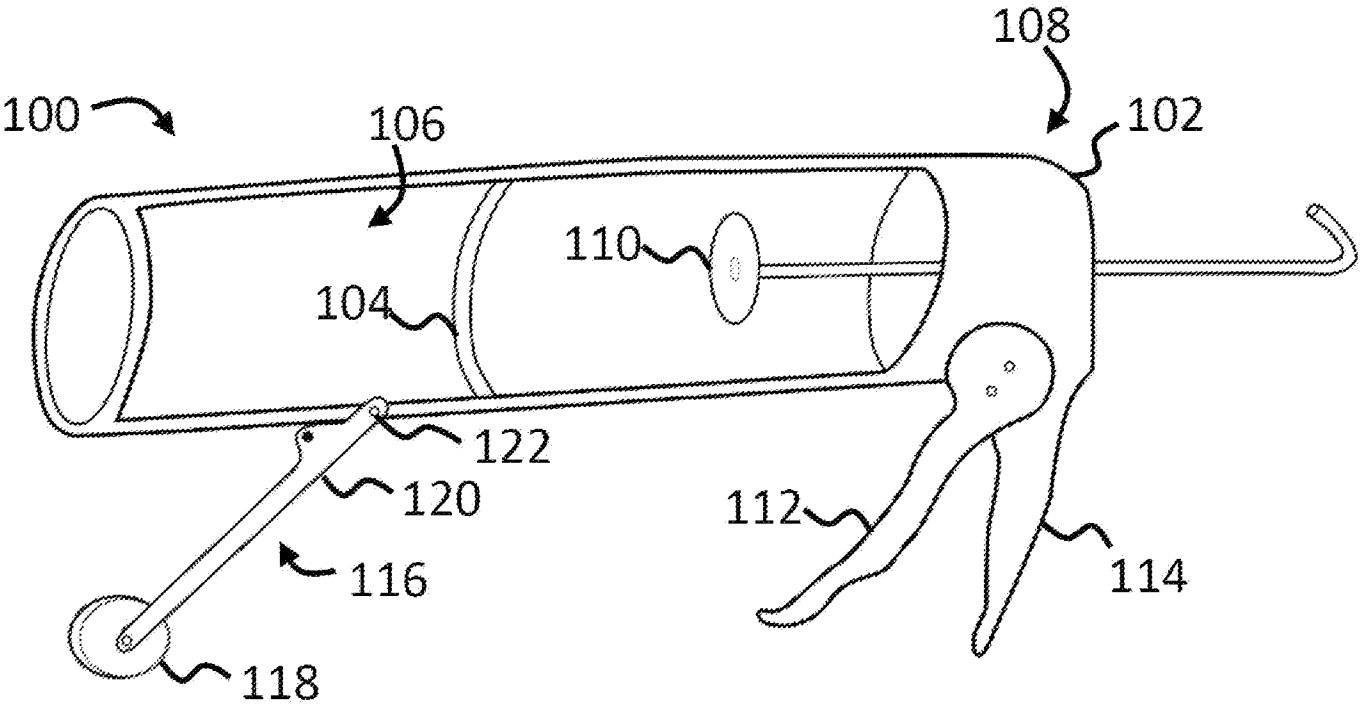
FIG. 1 shows an isometric view of an embodiment of a hand tool for the application of a viscous material with a movable guide in the operating position.

Further aspects and features of the example embodiments described herein will appear from the following description taken together with the accompanying drawings.

DETAILED DESCRIPTION OF THE EMBODIMENTS

Various embodiments in accordance with the teachings herein will be described below to provide an example of at least one embodiment of the claimed subject matter. No embodiment described herein limits any claimed subject matter. The claimed subject matter is not limited to devices or methods having all of the features of any one of the devices or methods described below or to features common to multiple or all of the devices or methods described herein. It is possible that there may be a device or method described herein that is not an embodiment of any claimed subject matter. Any subject matter that is described herein that is not claimed in this document may be the subject matter of another protective instrument, for example, a continuing patent application, and the applicants, inventors or owners do not intend to abandon, disclaim or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled" or "coupling" as used herein can have several different meanings depending on the context in which these terms are used. For example, the terms coupled or coupling can have a mechanical, fluidic or electrical connotation. For example, as used herein, the terms coupled or coupling can indicate that two elements or devices can be directly connected to one another or connected to one another through one or more intermediate elements or devices via an electrical signal, electrical connection, a mechanical element, a gas, a fluid or a fluid transport pathway depending on the particular context.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5% or 10%, for example, if this deviation does not negate the meaning of the term it modifies.

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

Hand tools for the application of viscous materials may be operated from a handheld position for long periods of time. In addition, hand tools for the application of viscous materials may be of considerable mass and may feel heavier the longer the operator is using it. The combination of these factors may result in operator fatigue. This has both health and safety consequences, as well as performance consequences. In particular, precise application of the viscous material to desired areas may be impacted by fatigue. This is important since precise application of viscous material extruded by the hand tool is necessary to ensure proper performance. Fatigue which impacts precise application of free flowing pasty materials may, by extension, compromise the performance of the viscous material (e.g. adhesive, filler and/or seal) after it is applied. Furthermore, operators may sustain injuries by operating hand tools for the application of viscous materials for long periods when the operator is not given any additional physical support for the hand tool.

As described herein, guides or support mechanisms attached to hand tools for the application of viscous materials may counteract fatigue directly, by reducing the weight an operator must bear when operating the tool, as well as counteract the consequences of fatigue, such as imprecise application of the extruded viscous material. This may be accomplished by providing the guide such that it may be used to align application of the extruded viscous material to a physical point of reference, such as a groove or line, while also providing support for the weight of the hand tool.

In conventional hand tools, a guide or support means may be permanently attached to the tool in a specific position. This may be problematic in use cases in which high maneuverability is required. A permanently attached guide may mechanically interfere with obstacles that may be in the path of an operator, impeding the application of free flowing pasty materials to surfaces. Furthermore, it may be difficult to store such hand tools when the guides are in a fixed immovable position.

In some other conventional hand tools, the guide or support means may be removable. A removable guide allows an operator to fully separate the guide from the hand tool in use cases where the guide is no longer advantageous. For example, when there is no appropriate datum or support surface to make use of the guide, the guide may provide the operator with no advantage. In other use cases, the guide may actively hinder the use of the tool, such as when the guide physically interferes with an obstacle. In other cases, the guide may be removed when the hand tool is stored. However, a removable guide requires storage of the guide when it is not attached to the hand tool. There is therefore a risk that the guide may be misplaced during the course of storage or the operator may forget where the guide was stored.

In accordance with one aspect of the teachings herein, at least one example embodiment of a hand tool is provided with a guide that is movably attached to the hand tool. The guide may be manipulated in such a manner that it may be fully operational and beneficial in one configuration, and physically stowed in a second configuration, in which the guide is unlikely to physically interfere with any obstacles in the path of the operator's application when the guide is not needed or the hand tool is no longer needed and is stored. Furthermore, since the guide is attached to the hand tool, the guide itself cannot be misplaced and lost.

In accordance with another aspect of the teachings herein, at least one example embodiment of a hand tool with an attached guide for the application of viscous materials is provided herein, in which the guide can be manipulated between at least two distinct configurations: (1) an engaged or operating position; and (2) a storage position. When the guide is in the engaged position, the operator may make use of the guide during application of the viscous material. When the guide is in the storage position, the guide is unlikely to interfere with the operation of the tool. The storage position has the additional advantage that when the hand tool is placed in storage, the guide is stored with the hand tool. In the storage position, the guide is also closer to the body of the hand tool such that the hand tool may also have a smaller physical footprint, compared to its configuration with the guide in the engaged position, and the smaller footprint may allow an individual to store the hand tool in a smaller space. The smaller footprint of the storage position may also facilitate easier transportation of the hand tool.

Referring now to FIG. 1, shown therein is an isometric view of an example embodiment of a handheld tool 100 with a movably attached guide 116 for the application of free flowing pasty materials to a surface. The tool 100 comprises a body 102 that is made from any suitable material. This includes, but is not limited to, steel, aluminum, polycarbonate, ABS, or other polymers. In the example embodiment of FIG. 1, the body 102 is comprised primarily of steel.

A section of the body 102 may be designated as the frame 104 which defines a cavity 106 within the body 102. The cavity 106 is the size of a dispensing container 107. Dispensing containers may be any commercially available containers for holding viscous materials including, but not limited to, caulking, sealants, adhesives, glue, silicon, PL glue, cement caulking, paste, resin, filler or any other suitable sealing materials, for example, with an end that can provide the viscous material during use.

It should be understood that different versions of the handheld tool may be different sizes to accommodate different types of dispensing containers. For example, one embodiment of the handheld tool may be sized to hold a 300 mL dispensing container, and other embodiments may be sized to hold a smaller or larger dispensing container. This size variation also applies to the other embodiments described herein.

Dispensing containers comprise a main body, a first end and a second end. The first end typically comprises a dispensing nozzle and the second end typically comprises a moveable element, such as a disk, onto which the operator may apply force to extrude the viscous material contained within the dispensing container out of the nozzle at the first end. During use, the dispensing container 107 is generally installed inside the cavity 106.

A dispensing assembly 108 may be located at one end of tool 100, and may be connected to the tool body 102. The dispensing assembly 108 may be used to dispense the viscous material from the dispensing container 107. A component of the dispensing assembly 108 is a forcing member 110. In the example embodiments shown in FIGS.

1-7, dispensing assembly 108 comprises a forcing member 110 in the form of a mechanical plunger.

Attached to the tool body 102 is a control element 112 and a handle 114. In the example embodiments shown in FIGS. 1-7, the control element 112 is a hand actuated mechanical lever. An operator can grip the control element 112 and the handle 114 using one hand. The operator can then apply a force to the control element 112 in order to advance the business end of the forcing member 110 against the second moveable end of the dispensing assembly 108. In the example embodiments shown in FIGS. 1-7, the control element 112 and the forcing member 110 are mechanically coupled. The control element 112 mechanically advances a ratcheting mechanism (not shown) within the dispensing assembly 108, which is coupled to the forcing member 110. Through this advancement, the forcing member 110 applies a force to the moveable end of the dispensing container 107. The viscous material within the dispensing container 107 is in mechanical communication with the moveable of the dispensing container 107. Due to this communication, the force applied onto the moveable end of the dispensing container 107 is transferred to the viscous material in the dispensing container 107, increasing the internal pressure within the dispensing container 107, and forcing the viscous material out of the nozzle 130 of the dispensing container 107 when the nozzle is open (i.e. is not capped or uncut).

In other embodiments, the dispensing assembly 108, and the control element 112 may be implemented differently. For example, in some embodiments, the dispensing assembly 108 may be implemented using an electric motor drive screw drive assembly, and the control element 112 may be implemented using an electrical switch. In some cases, this switch may be a trigger switch. In such cases, when the operator actuates the switch of control element 112, a circuit is completed, supplying the electric motor of the screw drive with an electric current. The electric current urges the motor to rotate, which in turn linearly advances the forcing member 110, which is mechanically coupled to the screw drive of dispensing assembly 108. Through this advancement, the forcing member 110 applies a force to the moveable end of the dispensing container 107. The viscous material within the dispensing container 107 is in mechanical communication with the plunger of dispensing container 107. Due to this communication, the force applied onto the moveable end of the dispensing container 107 is transferred to the viscous material in the dispensing container 107, forcing the viscous material out of the nozzle 130 of dispensing container 107 when the nozzle is open (e.g. not capped or otherwise blocked).

Attached to the body 102 is the moveably attachable guide 116. The guide 116 may be implemented in different ways. In the example embodiments shown in FIGS. 1-7, the guide 116 comprises a wheel 118, and a member 120. In other embodiments, not shown, the guide 116 may not contain a wheel 118, and instead, may have a different guide element or may comprise member 120 alone or an alternative embodiment of member 120. As shown in FIGS. 1-6, the member 120 may be attached to the frame 104 by a pin 122. In some embodiments, the pin 122 may be steel. In other embodiments, other attachment mechanisms may be used, including screws, rivets, bolts, and any other suitable fasteners. The use of the pin 122 allows the guide 116 to pivot or rotate around the pin 122, in order to vary the position of the guide element of the guide 116.

In FIGS. 1, 2A, 2B and 3, the guide 116 is shown in the operating position. In the operating position, the operator may make use of the guide 116 during the operation of the tool 100. Also in the operating position, the guide wheel 118 may be placed on a datum reference or surface and may be used to guide precise application of the viscous material and or reduce the load that must be borne by the operator during the operation of the tool 100 by transferring a portion of the force of the weight of the tool 100 onto the surface contacted by the guide 116.

In at least one embodiment, the guide wheel 118 may be made of a plastic or rubber material. In some embodiments, the guide wheel 118 may be made of a soft, light and white material designed not to mark up the surface that is receiving the viscous material during use of the tool. As described above, there may be embodiments of the hand tool that are sized to contain a larger tube of viscous material in which case the wheel 118 may also be larger and/or made of sturdier material to withstand the greater weight of the larger hand tool and larger dispensing tube.

Figure 2A:
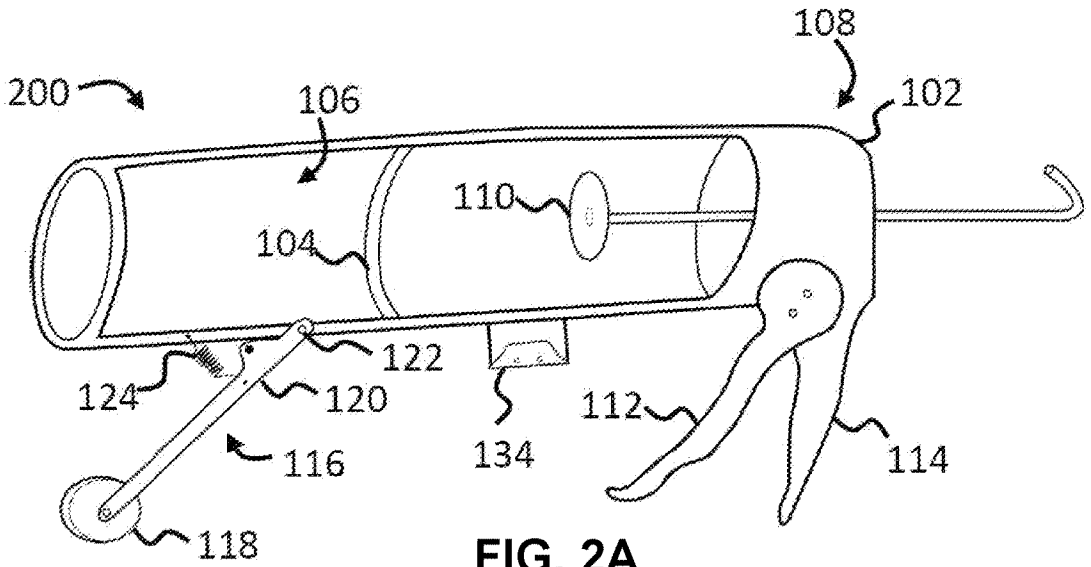
FIG. 2A shows an isometric view of an alternative embodiment of a hand tool for the application of a viscous material with a movable guide in the operating position.
Figure 2C:
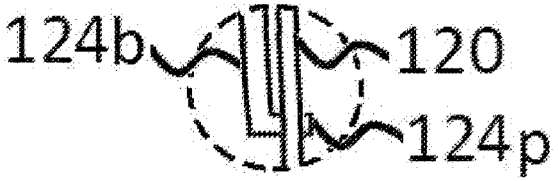
FIG. 2C shows a magnified view of a portion of the hand tool of FIG. 2B.
Figure 2B:
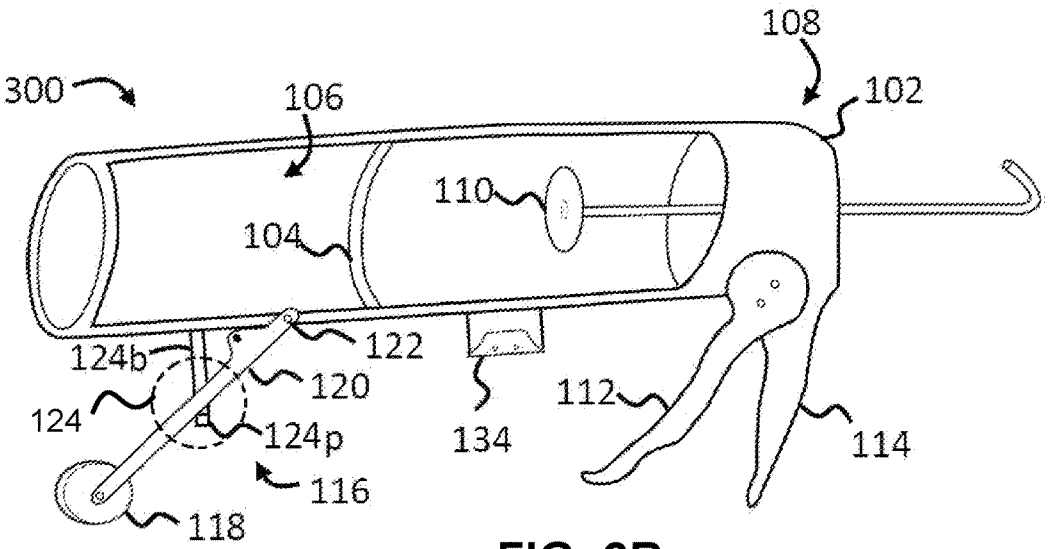
FIG. 2B shows an isometric view of another alternative embodiment of a hand tool for the application of a viscous material with a movable guide in the operating position
Figure 3:
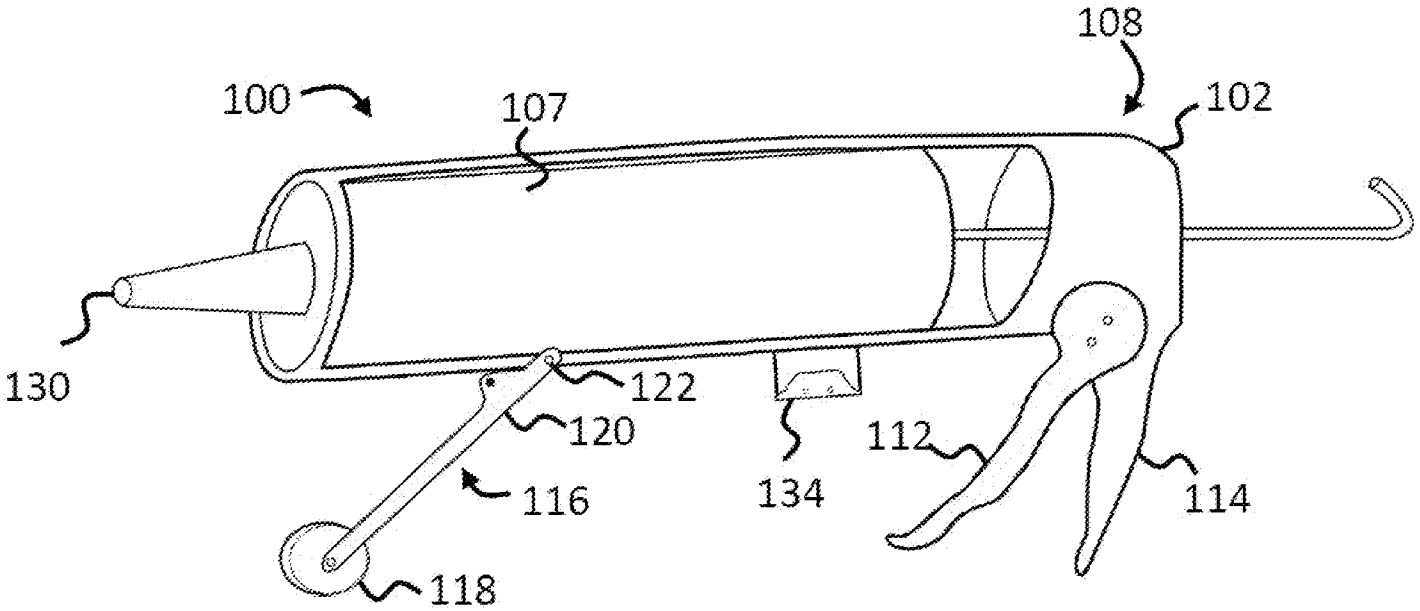
FIG. 3 shows an isometric view of the hand tool of FIG. 2A, when the hand tool contains a dispensing container.

In some example embodiments, see for example the embodiments shown in FIGS. 2A-2C, the tool 100 may further comprise a biasing member 124 that is attached to the member 120 of the guide 116. The biasing member 124 may bias the movable guide 116 towards a certain position. For example, in the embodiments shown in FIGS. 2A-2C, the biasing member 124 is used to bias the guide 116 towards the operating position, after the guide has been rotated towards the operating position such that the guide wheel 118 is closer to the nozzle 130 end of the tool 100 rather than to the dispensing mechanism 108 end of tool 100. In the example embodiments shown in FIG. 2A, the biasing member 124 is a coiled spring, which may be made of metal or plastic. In the example embodiment shown in FIGS. 2B-2C, the biasing member 124 is a post having a vertical section 124*b* and a horizontal section 124*p* which are slightly flexible to allow the member 120 to pass by the post when the guide wheel 118 is being moved between the operating and storage positions. The post 124 may be made of metal or a strong plastic that can pivot slightly at the base of the frame 104. In other example embodiments, the biasing member 124 may be a wire loop, a polymer based elastic or any other suitable component that may be used to bias the guide 116 towards the operating position. In other embodiments, the biasing member 124 may instead be implemented so that the guide 116 is biased towards the storage position.

It should be noted that the guide 116 of the hand tool 100 of FIG. 1 may be held in place by using a stiff pivot mechanism for the pin 122 such that an appreciable amount of force is needed to move the guide 116 between the operating and storage positions so that the guide 116 does not move easily, for example, when accidental contact is made with the guide 116 and this accidental contact is not intended to move the guide 115. For example, the pin 122 may make a friction fit with the pivot mechanism. In an alternative embodiment, a first small ridge or flange (or pair or ridges or flanges) oriented parallel to the longitudinal axis of the body 102 may be disposed at a first location on the body 102 to be engaged by a first portion of the guide 116 to maintain the guide 116 in the operating position. Likewise, a second small ridge or flange (or pair of ridges or flanges) oriented parallel to the longitudinal axis of the body 102 may be disposed at a second location on the body 102 to be engaged by a second portion of the guide 116 to maintain the guide 116 in the storage position.

Figure 4:
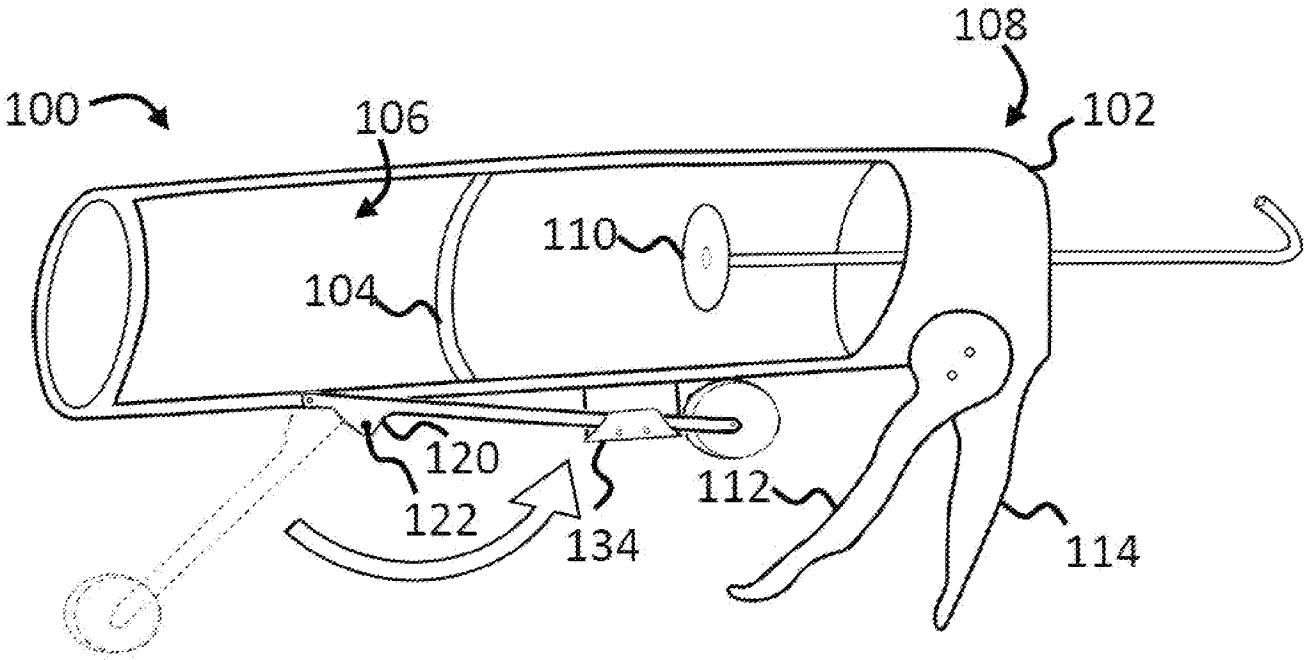
FIG. 4 shows an isometric view of an alternative embodiment of a hand tool with a moveable guide for guiding the application of viscous material where the moveable guide in the storage position.

Referring now to FIG. 4, shown therein is the tool of FIG. 1, with the guide 116 having been transitioned from the operating position to the storage position. The guide 116 in the operating position is shown in dashed lines. To translate the guide 116 from the operating position to the storage position, the guide 116 may be rotated about pin 122, away from the nozzle end of the tool 100 towards the dispensing mechanism 108 end of the tool 100 and positioned on the inside of a retaining member 134 where it is maintained in the storage position by a friction fit between portions of the guide 116 and a flange or a channel of the retaining member 134 that contact one another. The retaining member 134 may also be included in embodiments which include a biasing member 124, in which case the friction fit between the guide 116 and the retaining member 134 resists the biasing force of the biasing member 124, allowing the guide 116 to be held in the storage position 116. The retaining member 134 may be attached to a portion of the body 102 of the tool 100 or the retaining member 134 may be an integral part of the outer surface of the body 102. In other embodiments, other mechanisms may be used to oppose the force of the biasing member 124 and to maintain the guide 116 in specific, desired positions. These may include straps, snaps, pins, screws, bolts or any other suitable mechanisms.

Figure 5:
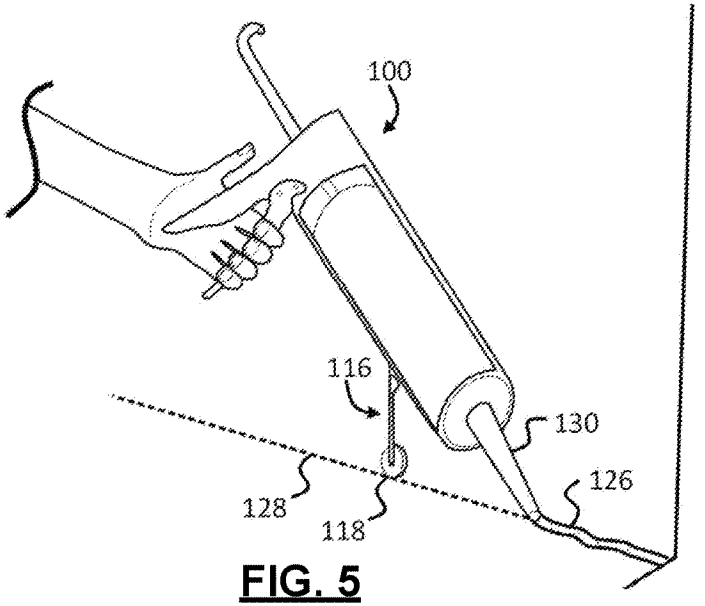
FIG. 5 shows an isometric view of the hand tool of FIG. 1, in use, with the movable guide in the operating position, for guiding the application of the viscous material.

Referring now to FIG. 5, shown therein is the tool 100 of FIG. 1, in use, with the guide 116 in the operating position. An operator's arm is shown in FIG. 5 to be grasping the tool 100 with one hand. Also shown in FIG. 5 is a datum 128 which functions as both a path for the operator to pass the guide wheel 118 over while extruding the viscous material 126 from the nozzle 130 of tool 100, and the desired line of application of the viscous material. In use, the operator applies pressure to the control element 112 while passing tool 100 along datum 128. During this process, the guide wheel 118 remains in contact with the datum 128 and the nozzle 130 remains in contact with, or close to, the datum 128. As the tool 100 passes over the datum 128, the viscous material 126 may be extruded onto the datum 128. Accordingly, the guide 116 may provide the operator with relief from fatigue by reducing the weight that must be borne by the operator during the operation of the tool 100. By reducing weight borne by operator, the operator may be able to apply the viscous material 126 with higher precision than would otherwise be possible without the guide 116. Furthermore, the guide wheel 118 runs along the datum 128 as the operator moves the tool 100 which allows the operator to more accurately apply the viscous material 126 to the datum 128.

The guide 116 and the guide wheel 118 may be vertically aligned with the nozzle 130 of the tool 100. By vertically the aligning nozzle 130 with the guide 116, the operator may be certain that the placement of the guide 116 along a reference line or datum 128 will correspond with the application of the viscous material to the datum 128, as long as the tool 100 is held such that the end of the nozzle 130 is also lined up with the datum 128.

Figure 6:
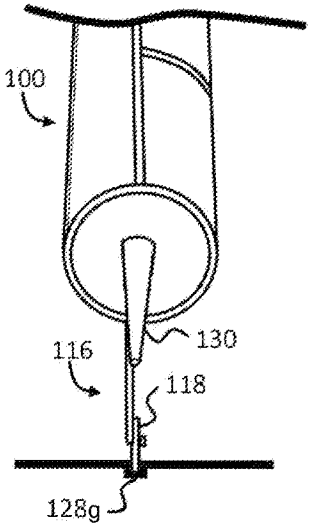
FIG. 6 shows a truncated front isometric view of the hand tool of FIG. 1 for the application of a viscous material in use, with the movable guide in the operating position.

In other use cases, such as that shown in FIG. 6, the guide wheel 118 may be in contact with a datum groove 128*g*, that is to be filled with the viscous material. The nozzle 130 may also be in contact with the groove 128*g*, which allows the operator to contact the application surface with two points of contact. This may provide the operator with additional stability beyond that afforded by the guide 116 alone, thereby further increasing the precise application of the viscous materials with tool 100.

Figure 7:
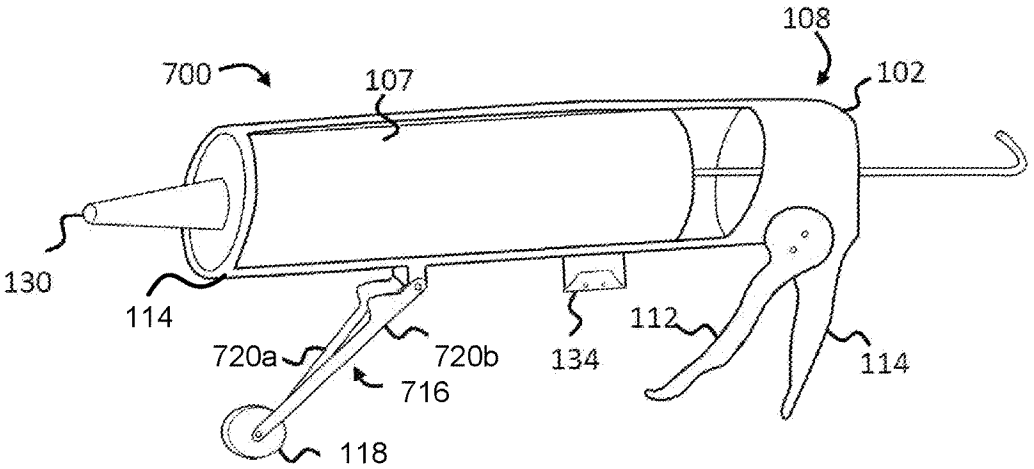
FIG. 7 shows an isometric view of an example of an alternative embodiment of a hand tool for the application of a viscous material with a movable guide having two points of attachment and shown in the operating position.

Referring now to FIG. 7, shown therein is an example of an alternative embodiment of a hand tool 700 in accordance with the teachings herein. The tool 700, shown in FIG. 7 is similar to that shown in FIGS. 2-6, except the tool 700 of FIG. 7 includes a guide 716 having two members 720*a* and 720*b*, allowing for two points of contact or attachment for the guide 716 onto the frame 114 of the tool 700. Two points of attachment may increase stability and/or the weight bearing capability of the guide 716, which may improve performance. Otherwise, the guide 716 operates in a similar manner as the guide 116 described above. Also, the tool 700 may be modified in other embodiments to include the biasing mechanisms described previously.

Figure 8:
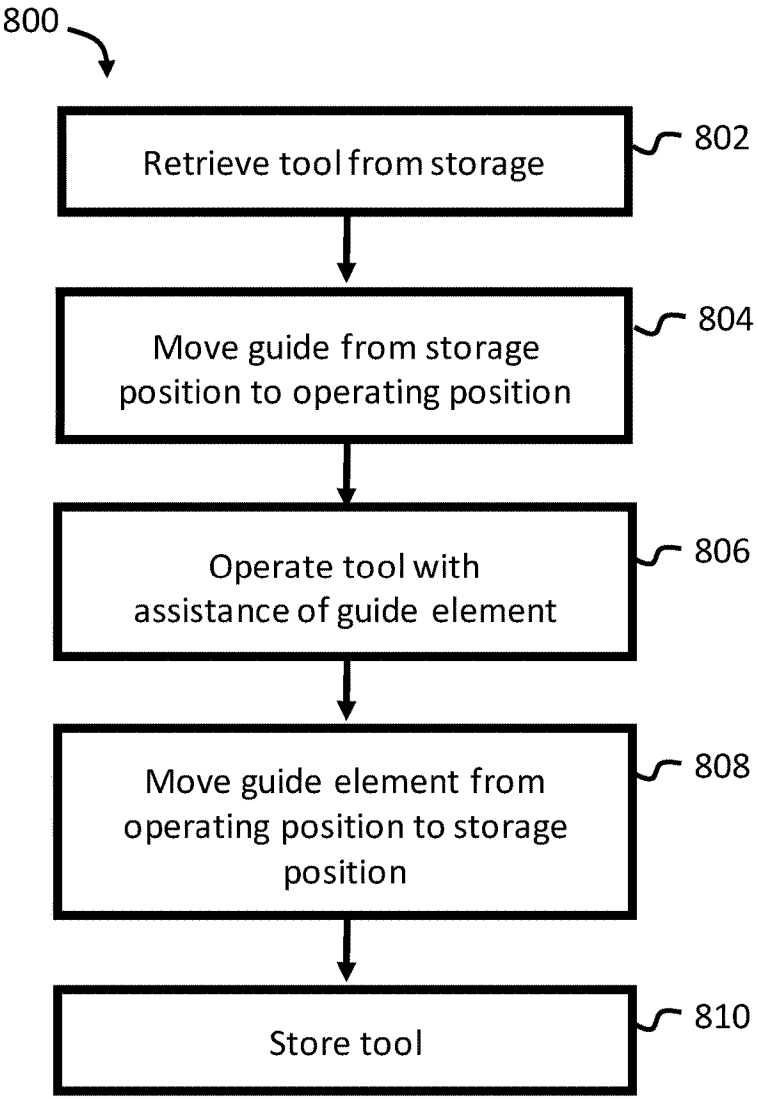
FIG. 8 shows a flow chart of an example embodiment of a method of use of a hand tool with a movable guide for the application of a viscous material.

Referring now to FIG. 8, pictured therein is a flowchart detailing an example embodiment of a method of operation 800 of any of the tools described herein. For illustrative purposes use of the tool 100 of FIG. 1 will be described in the context of method 800. At act 802, the operator retrieves the tool 100 from storage with the guide 116 in the storage position. At act 804, the operator rotates the guide 116 from the storage position to the operating position. To do so, in other embodiments, the operator may be required to move the guide 116 past the retaining member 134. Assuming that the dispensing container 107 has already been loaded into the tool 100, then at act 806, the operator operates the tool 100 with the guide 116 in the operating position, as pictured, for example, in FIG. 5. During operation, the operator may use the entire contents of the current dispensing container 107 and may have to load a new dispensing container 107 into the tool 100 to continue operation. Loading a new dispensing container 107 into the tool can be done with the guide 116 in the operating or storage position. When the operator is finished using the tool 100, at act 808, the operator rotates the guide 116 from the operating position to the storage position. In an embodiment of tool 100 including biasing member 124, the operator has to overcome the force of the biasing member 124 to complete act 808. Before or after act 808, the operator may remove the dispensing container 107 from the tool 100. At act 810, the operator returns the tool 100 to storage.

Figure 9:
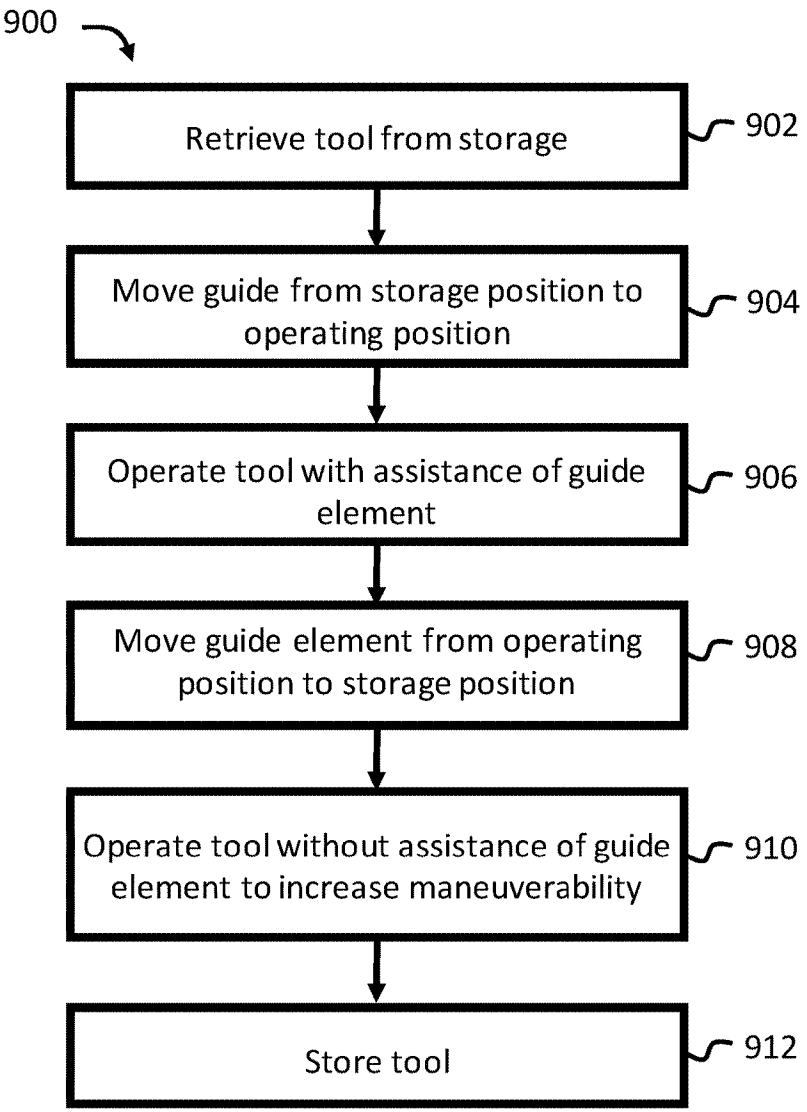
FIG. 9 shows a flow chart of an example embodiment of an alternative method of use of a hand tool with a movable guide for the application of a viscous material.

Referring now to FIG. 9, shown therein is a flowchart detailing an example of an alternative embodiment for a method of operation 900 of any of the tools described herein. For illustrative purposes, use of the tool 100 of FIG. 1 will be described in the context of method 900. At act 902, an operator retrieves the tool 100 from storage with the guide 116 in the storage position. At act 904, the operator rotates guide 116 from the storage position to the operating position. In embodiments of the tool with a retaining member 134, the operator may be required to move the guide 116 past the retaining member 134, in order to place the guide 116 into the operating position. Before or after act 904, the operator may load the dispensing container 107 into the tool 100. At act 906, the operator operates the tool 100 with the guide 116 in the operating position, as shown, for example, in FIG. 5. During the operation of step 906, the operator may encounter a scenario in which it may be advantageous to return the guide 116 to the storage position in order to overcome mechanical interference between the tool 100 and the operating environment. At act 908, the operator rotates the guide 116 from the operating position to the storage position. In embodiments, with a biasing member 124, the operator has to overcome the force of biasing member 124 to complete step 908. At act 910, the operator operates the tool 100 with the guide 116 in the storage position. This may afford the operator greater maneuverability, due to the reduced physical footprint of tool 100 with the guide 116 in the storage position. The operator can then continue using the tool 100. During operation, the operator may fully use the current dispensing container 107 and may have to load a new dispensing container 107 into the tool 100. The loading of a new dispensing container 107 into the tool may be done with the guide 116 in the operating position or the storage position. At step 912, when the operator is finished using the tool 100 the operator returns the tool 100 to storage. Before act 912, the operator may remove the dispensing container 107 from the tool 100.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

The invention claimed is:

1. A tool for applying a viscous material to a surface, comprising:

a body having a frame including at least a partial wall defining a cavity having a size for removably receiving a dispensing container that contains the viscous material;

a dispensing assembly that is operatively coupled to the body and has a forcing member for applying force to the dispensing container to dispense the viscous material;

a control element attached to the body for controlling the application of the applied force by the forcing member of the dispensing assembly; and a guide rotatably coupled to the body, the guide being rotatable between an operating position and a storage position.

2. The tool of claim 1, wherein a first proximal portion of the guide is rotatably coupled to a first portion of the body of the tool about a first pivot point to allow the guide to be rotated between the storage and operating positions.

3. The tool of claim 1, wherein the guide comprises two members each having proximal ends that are spaced apart from one another and coupled near the first portion of the body and distal ends that are coupled to one another.

4. The tool of claim 1, wherein a distal portion of the guide comprises a guide wheel to make contact with the surface when an operator is dispensing the viscous material during operation.

5. The tool of claim 1, wherein the tool further comprises a biasing member coupled between a second portion of the body and a second proximal portion of the guide for biasing the guide towards the operating position.

6. The tool of claim 1, wherein the tool further comprises a retaining member that is coupled to a third portion of the body and has a flange or a channel for receiving and maintaining a part of a distal portion of the guide in the storage position.

7. The tool of claim 1, wherein the forcing member comprises a plunger for applying the force to a movable end of the dispensing container.

8. The tool of claim 1, wherein the control element comprises a hand operated lever.

9. The tool of claim 1, wherein the tool further comprises a handle and the control element is rotatably coupled to the handle.

10. The tool of claim 9, wherein the handle is integrated into the body.

11. A method of operating a tool that is defined according to claim 1 where the tool includes the dispensing container, wherein the method comprises:

retrieving the tool;

rotating the guide from the storage position to the operating position;

operating the tool with the assistance of the guide;

rotating the guide from the operating position to the storage position; and storing the tool.

12. The method of claim 11, wherein the method further comprises operating the tool without the assistance of the guide after rotating the guide from the operating position to the storage position.

13. The method of claim 11, wherein the guide is a guide wheel, and wherein operating the tool with the assistance of the guide comprises contacting the surface with the guide wheel while dispensing the viscous material.

14. The method of claim 11, wherein a first proximal portion of the guide is rotatably coupled to a first portion of the body of the tool about a first pivot point and wherein rotating the guide from the storage position to the operating position comprises rotating the guide between the storage and operating position about the first pivot point.

15. The method of claim 11, wherein the tool further comprises a retaining member that is coupled to a third portion of the body and has a flange or a channel for receiving and maintaining a part of the distal portion of the guide in the storage position and wherein rotating the guide from the operating position to the storage position comprises engaging the guide with the retaining member.

* * * * *